United States Patent [19]

Bezubic

[11] Patent Number: 4,961,286

[45] Date of Patent: Oct. 9, 1990

[54] TOGGLE TILT LATCH FOR A TILTABLE WINDOW ASSEMBLY

[75] Inventor: William P. Bezubic, Indiana, Pa.

[73] Assignee: Season-all Industries, Inc., Indiana, Pa.

[21] Appl. No.: 366,497

[22] Filed: Jun. 14, 1989

[51] Int. Cl.[5] ..... E05D 15/22

[52] U.S. Cl. ..... 49/175; 49/161; 49/185; 49/449; 292/139

[58] Field of Search ..... 49/174, 175, 450, 453, 49/161, 181, 185, 186, 449; 292/139, 167, 158

[56] References Cited

U.S. PATENT DOCUMENTS

| | | | |
|---|---|---|---|
| 526,278 | 9/1894 | Wesson | 292/139 X |
| 2,626,658 | 1/1953 | Milone . | |
| 2,874,986 | 2/1959 | Henrichs | 292/167 |
| 3,109,675 | 11/1963 | Anderson . | |
| 3,129,470 | 4/1964 | Schneider | 49/450 |
| 3,181,905 | 5/1965 | Bisbing . | |
| 3,197,819 | 8/1965 | Trout . | |
| 3,452,478 | 7/1969 | Foster | 49/161 |
| 3,462,882 | 8/1969 | Brown, Jr. | 49/181 |
| 3,466,076 | 9/1969 | Bisbing | 292/109 |
| 3,478,547 | 11/1969 | Constable | 292/247 X |
| 4,025,096 | 5/1977 | Geer | 292/139 X |
| 4,068,406 | 1/1978 | Wood | 49/181 |
| 4,099,751 | 7/1978 | Poe et al. | 292/139 |
| 4,144,674 | 3/1979 | Dovman | 49/417 |
| 4,168,854 | 9/1979 | Fujitaki | 292/139 |
| 4,230,351 | 10/1980 | Bisbing | 292/223 |
| 4,356,667 | 11/1982 | Malachowski | 49/161 X |
| 4,525,952 | 7/1985 | Cunningham et al. | 49/449 |
| 4,627,650 | 12/1986 | Haushulte | 292/113 |
| 4,791,756 | 12/1988 | Simpson | 49/175 |
| 4,837,975 | 6/1989 | Simpson | 49/175 |

*Primary Examiner*—Philip C. Kannan

*Attorney, Agent, or Firm*—Arnold B. Silverman

[57] ABSTRACT

A toggle tilt latch for a tiltable window assembly which comprises a base adapted to be mounted to a window sash, a handle pivotally mounted to the base and a plunger operatively associated and movable with the handle. The plunger has a free end which protrudes from the base and engages the window frame when the window sash is in its normal vertical position. The plunger is retracted into the base by rotating the handle away from the base. This will allow the window sash to tilt inwardly relative to the window frame. The handle portion not only gives a ready visual indication of whether the plunger is retracted or not but also can be used as hand holds by a user to facilitate tilting of the window sash relative to the window frame.

54 Claims, 3 Drawing Sheets

TOGGLE TILT LATCH FOR A TILTABLE WINDOW ASSEMBLY

BACKGROUND OF THE INVENTION

1. Field Of The Invention:

This invention relates to a toggle tilt latch for a tiltable window assembly, and more particularly to a latch that gives ready visual indication to a user that the window sash can be tilted and that provides handles for the user to more easily tilt the window sash.

2. Description Of The Prior Art:

It is known to provide window sashes that not only slide vertically to open and close the window, but also tilt or pivot into the house or building to facilitate cleaning thereof. See, e.g., U.S. Pat. Nos. 3,462,882; 4,068,406; 4,144,674; and 4,525,952.

Tilting of the window sash may be accomplished by various means. For example, FIG. 8 of U.S. Pat. No. 4,144,674 shows a latch device having a main body which is undercut to provide a slot for a latching element. The latching element is spring biased at one end and has an outer beveled camming edge at the other end. A latch is provided on each side of the window sash. When it is desired to inwardly tilt the window sash, the camming edges of the latching elements are retracted by the user first placing his finger in an opening of the latch and forcing the latch element inwardly to free the beveled camming edge from the sidewalls of the window frame. To place the window sash back in its normal vertical position, the sash is swung inwardly to automatically cam the camming edge of the latching element inwardly. Once in position, the latching element is spring pressed outwardly to reengage the frame.

U.S. Pat. No. 3,452,478 discloses a latch arm pivotally mounted to a sash. A finger on the latch arm projects laterally for extension into a space between two flanges. In order to rotate the sash inwardly, the latch arm is rotated 90° clockwise, thus removing the finger from engagement with the forward flange.

Despite the above devices, there remains a need for a tilt latch mechanism that is easy to manipulate, provides a ready visual indication of when the window can be tilted and which also provides convenient handles which facilitate tilting of the window.

SUMMARY OF THE INVENTION

The toggle tilt latch for a tiltable window assembly has met the above-mentioned need. The latch mechanism has a base adapted to be mounted to a window sash, a handle pivotally mounted to the base and a plunger operatively associated and movable with the handle. The plunger has a free end which protrudes from the base and engages the window frame when the window sash is in its normal vertical position. The plunger is retracted into the base by rotating the handle away from the base. This will allow the window sash to tilt inwardly. The handle portion not only gives a ready visual indication of whether the plunger is retracted or not but also can be used as hand holds by a user to facilitate easy tilting movement of the window sash.

It is an object of the invention to provide a toggle tilt latch that enables a window sash to tilt inwardly.

It is a further object of the invention to give a ready visual indication of when a window is able to be tilted inwardly.

It is a further object of the invention to provide handles to facilitate easy tilting of the window sash.

It is a further object of the invention to provide a ventilation latch in combination with a tilting latch.

It is a further object of the invention to provide the handle with recesses for easy access to rotate the handle portion.

It is a further object of the invention that the handle acts to cover all parts of the latch to prevent accumulation of dust and dirt therein and to prevent tampering with the internal mechanism of the latch.

It is a further object of the invention to provide a latch lock as part of the toggle tilt latch.

These and other objects of the invention will be more fully understood from the following description of the invention with reference to the drawings appended hereto.

DESCRIPTION OF THE PREFERRED EMBODIMENT

Figure 1:
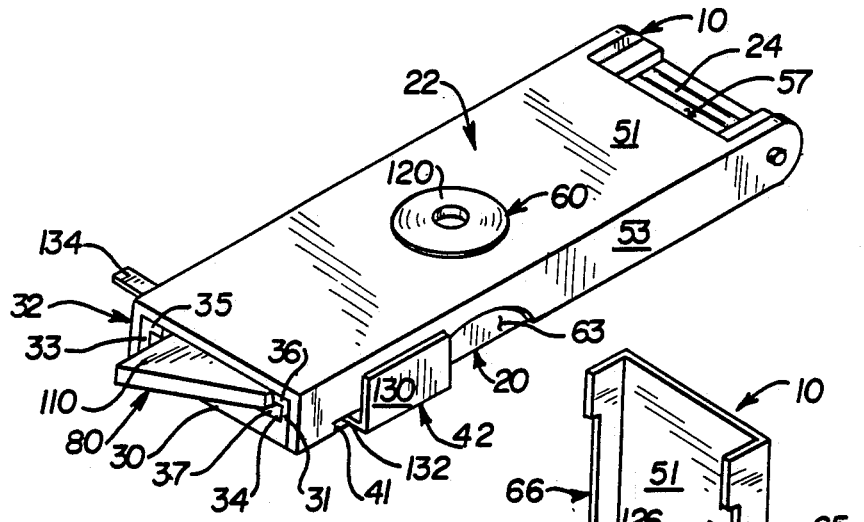
FIG. 1 is an isometric view of the toggle tilt latch of the present invention showing the camming end protruding from the base.
Figure 2:
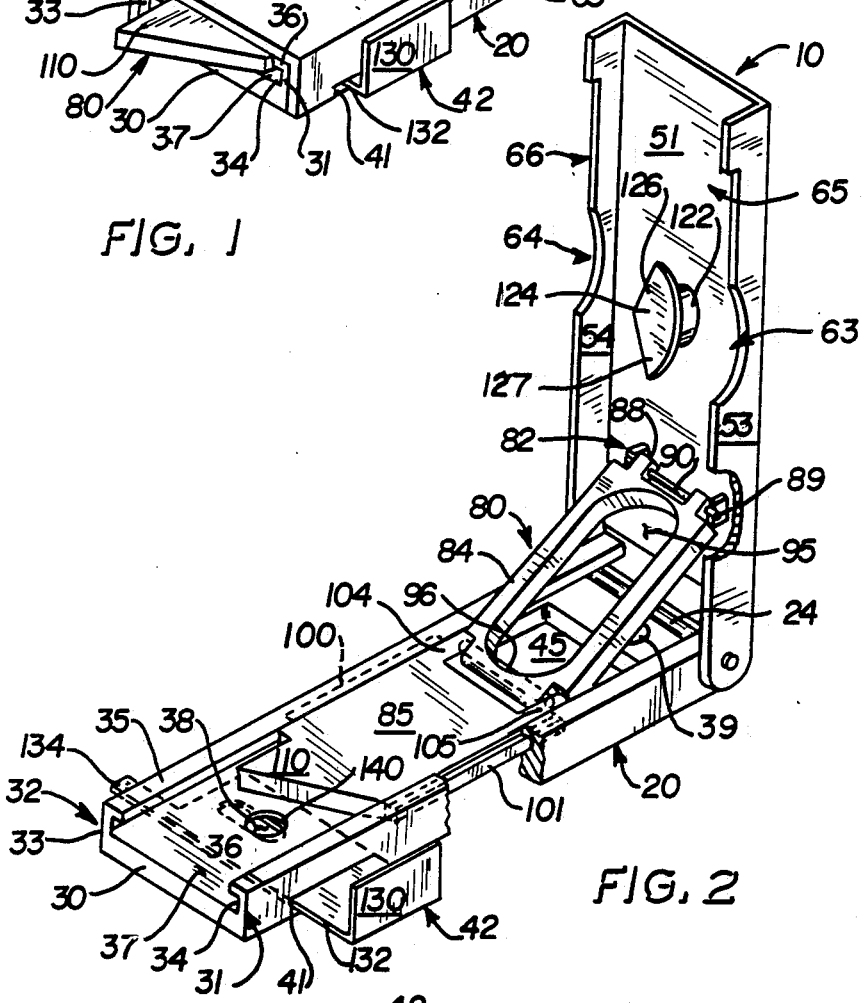
FIG. 2 is an isometric view of the tilt latch when the handle is rotated away from the base.

Referring to FIGS. 1 and 2, the toggle tilt latch 10 of the invention is comprised of a rectangular base 20 and a rotatably mounted handle 22. The handle 22 is rotatably mounted to the base by a pivot pin 24 which connects both the base 20 and handle 22. The base 20 consists of a base wall 30 and two flanged sidewalls 31 and 32. The sidewalls 31, 32 each consist of a longitudinal portions 33, 34 and inwardly projecting horizontal portions 35, 36. The flanged sidewalls define a recessed track 37. The base 20 also has two screw holes 38 and 39 which will facilitate mounting the latch onto a window sash.

Figure 3:
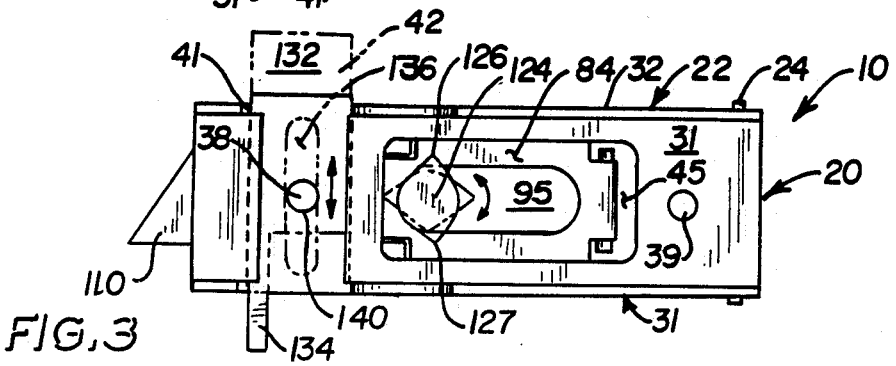
FIG. 3 is a bottom plan view showing operation of the locking means and the ventilation latch.

The base 20 also has a slot 41 in which is mounted a standard ventilation latch 42. The ventilation latch will be described hereinafter with reference to FIG. 3. Base wall 30 also defines a hole 45 as can be seen by FIGS. 2 and 3. This will facilitate use of the locking means 60 which will be explained hereinafter. The base 20 can be made of zinc die cast, aluminum die cast, aluminum extrusion, stainless steel, bronze or hard plastics and is preferably about 2 to 4 inches in length, 1 to 2 inches in width and ¼ to ½ inch in height.

The handle portion 22 consists of an end wall 51 and two sidewalls 53, 54. The end wall 51 is preferably rectangular and consists of a recess 57 at one end thereof. This recess 57 permits the handle 22 to rotate away from the base 20. The end wall 51 also has an associated locking means 60, which will be described further hereinafter. The sidewalls 53, 54 have half-moon recesses 63, 64 and ventilation latch recesses 65, 66. The half-moon recesses 63, 64 facilitate gripping and manipulating the handle 22 and the ventilation latch recesses 65, 66 allow the ventilation latch 42 to protrude from the sidewalls 31, 32 of the base 20.

The handle 22 is rotatably mounted to the base 20 by pivot bar 24, which is placed through sidewalls 53, 31, 32, 54 respectively. Handle 22 is designed so that sidewalls 53 and 54 are outside and adjacent to sidewalls 31 and 32 when the latch is in the position shown in FIG. 1. Thus in the form shown, handle 22 completely covers, except for the half-moon recesses 63, 64, the base 20. This will resist dirt and dust from accumulating in and around the base 20 and will also resist tampering with the internal mechanism of the latch 10.

Handle 22 is preferably made of the same materials as the base 20 and is preferably 2 to 4 inches in length, 1 to 2 inches in height, and ¼ to ½ inch in width. If desired, handle 22 can be painted or otherwise treated, to have a different color or texture from base 20.

Referring particularly to FIG. 2, the plunger 80 will be discussed. The plunger 80 consists of mounting means 82, connecting link 84, and plunger engagement end 85. The mounting means 82 consists of two mounting posts 88 and 89 and a pivot bar 90 which goes through one end of the connecting link 84. The pivot bar 90 connection allows the connecting link 84 to rotate inwardly and upwardly when the handle 22 is rotated away from the base 20 (from the position of FIG. 1 to that of FIG. 2).

The connecting link 84, as shown, is a rectangular shape defining an opening 95 in the center. This opening 95 facilitates the operation of the locking means 60. The connecting link 84 is rotatably attached to the plunger engagement end 85 by means of a second pivot bar 96. This pivot bar 96 connection allows the connecting link 84 to rotate inwardly and upwardly when the handle 22 is rotated away from the base 20.

The plunger engagement 85 is slidably mounted in track 37 by means of two narrowed side portions 100 and 101. The plunger engagement 85 has a recessed portion formed by two extensions 104, 105 on one end thereof and a triangular extension 110 on the other end thereof. The wings 104 and 105 are positioned to be outside and adjacent the connecting link 84. This will facilitate mounting of the second pivot bar 96 to the connecting link 84 and plunger engagement 85.

The locking means 60 is shown in FIGS. 1-3, with FIG. 3 showing the operation thereof. The locking means 60 consists of a top portion 120 mounted on the handle 22 on one end of a spool portion 122 and a locking portion 124 mounted on the opposite end of spool portion 122. The locking portion 124 has wings 126, 127. In a first position, the wing portions 126 and 127 are positioned so that they do not contact the edges of the connecting link 84 forming the opening 95. When it is desired to lock the toggle latch so that it cannot be rotated from the position of FIG. 1 to the position of FIG. 2, a user merely rotates top portion 120, which in turn rotates spool portion 122, placing portion 124 in the position shown by dotted lines in FIG. 3. The wings 126 and 127 now engage the edges of the connecting link 84 which form opening 95. This will resist connecting link 84 from moving and thus resist moving the handle 22 away from the base 20. Top portion 120 is preferably rotatable by using a tool to prevent inadvertent or purposeful tampering with the locking means 60.

The ventilation latch 42 is shown in FIGS. 1-3, with FIG. 3 showing the operation thereof. The ventilation latch 42 is slidably mounted in slot 41 of the base 20. The ventilation latch 42 consists of an upturned flange portion 130 and a rectangular base portion 132 having a finger extension 134. Rectangular base portion 132 has an elongated slot 136. A screw 140 (FIGS. 2 and 3) is placed in a screw hole 38 in base 20. The screw 140 goes through slot 136 and can be tightened so as to fix the position of the ventilation latch 42 relative to the base 20. It will be appreciated that the slot 136 is used to provide a range of positions for the ventilation latch 42 relative to the base 20. The ventilation latch 42 can be moved in the direction of the arrows in FIG. 3. The operation of the ventilation latch 42 will be explained with reference to FIG. 4.

Figure 4:
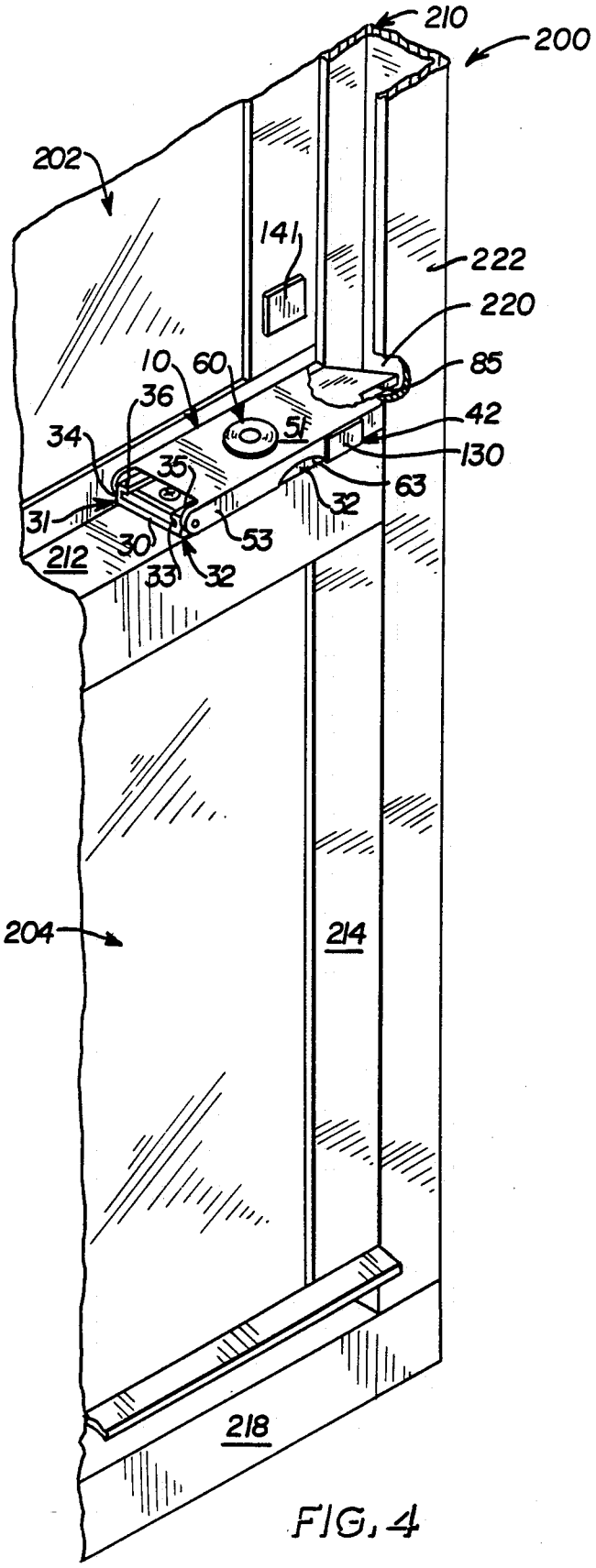
FIG. 4 is a front isometric view, partially in section, of the latch mounted on a window sash in a window frame.
Figure 5:
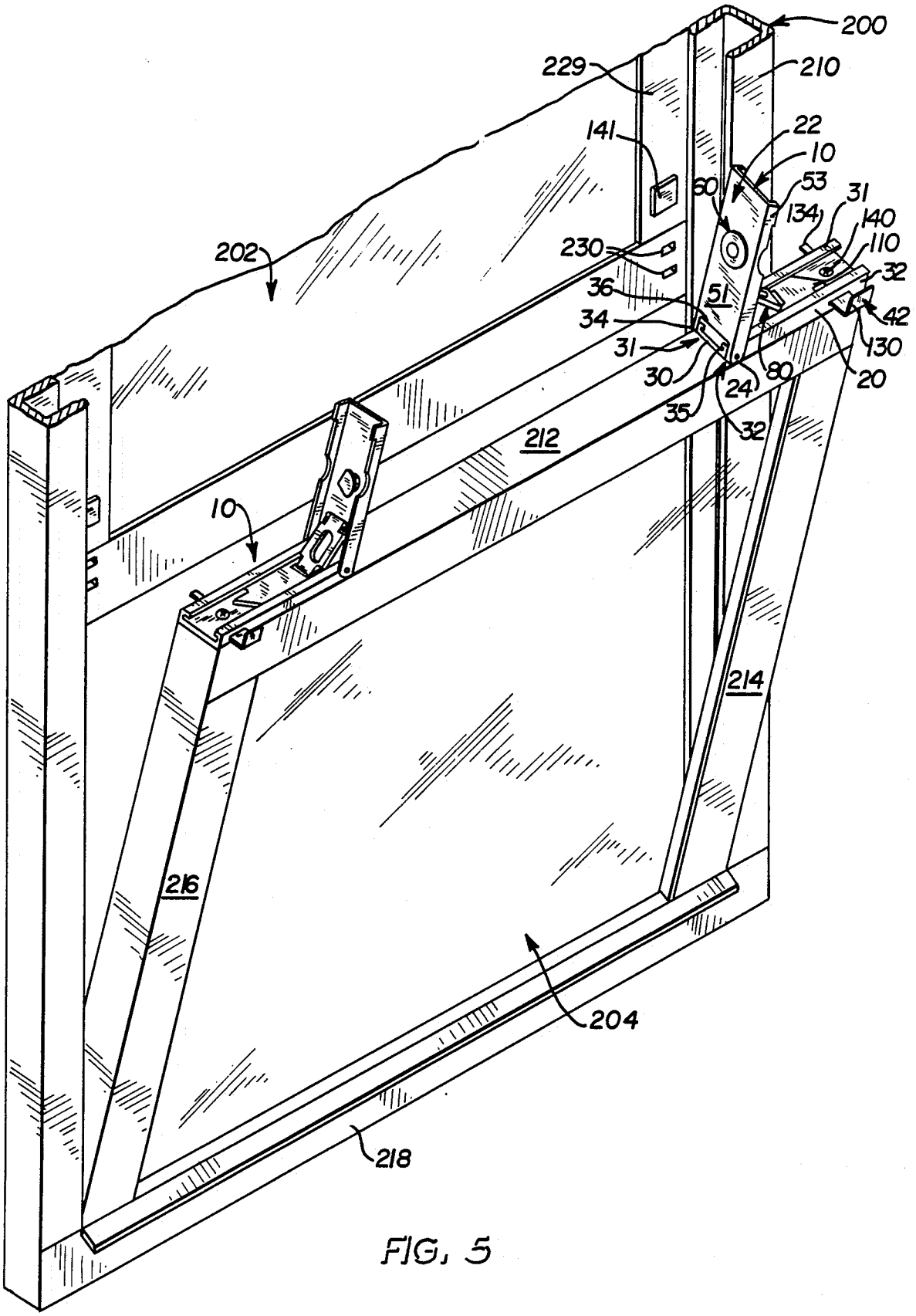
FIG. 5 is an isometric view showing the latch mounted on a window sash in a window frame when the handle is rotated from the base so that the window may be tilted inwardly.

Referring now to FIGS. 4 and 5, a window assembly consisting of a double hung window sash with the latch 10 will be discussed. FIGS. 4 and 5 show a standard double hung window assembly 200 having an upper sash 202 and a lower sash 204. The sashes are mounted in a window frame 210. The lower sash is comprised of a top rail 212, first vertical rail 214, second vertical rail 216, and bottom rail 218. Two latches 10, 10 are mounted on the top rail 212 of the lower sash 204 as shown in FIG. 4. It will be appreciated that the latches 10, 10 can be flush mounted on the top rail 212 or can buried in the top rail 212.

The latch 10, shown in FIG. 4 is in a closed position indicating that the window sash 204 cannot be tilted inwardly. As can be seen in the right hand latch 10 of FIG. 4, the plunger engagement 85 engages into a channel 220 in the vertical member 222 in the window frame 210. The plunger 85 travels against the channel 220 acting as both a guide and as a positive locking mechanism to prevent inward rotation of the lower sash 204.

When it is desired to tilt the window sash 204, the locking means 60 is disengaged (if necessary) and the handle 22 is rotated away from base 20 to the position shown in FIG. 5. The rotation of the handle 22 will in turn retract plunger engagement 85 from the channel 220 of the vertical member 222, 222 of the window frame 210. This, in turn allows the lower sash 204 to pivot in on the balance shoe mechanism (not shown). The second latch 10 on the other end of the rail 212 is also rotated to the position shown in FIG. 5. The lower sash 204 can then be tilted by a user engaging the handles 22 and pulling the lower sash 204 inward toward himself.

It will be appreciated that the handles 22 of the latches 10 not only provide a ready visual indication of whether the window is able to be tilted or not, but also provide an easy way to grasp the window sash to facilitate tilting the same inwardly.

Referring now to FIG. 5, the ventilation latch 42 is operated by pushing inwardly the upturned flange portion 130 to move the finger extension 134 inwardly. The finger extension 134 will engage a strike block 141 mounted on the vertical rail 229 of the upper sash 202. The block 141 will act as a stop to allow the lower sash 204 to travel a predetermined distance thus allowing limited opening of the window sash 204. Retracting the ventilation latch 42 so that the finger extension 134 is not able to contact the striker block 141 will allow normal mode operation of full travel of the lower sash 204 in the window frame 210. As an alternative, holes 230 in the vertical rail 229 can be provided. The finger extension 134 can engage into these holes 230 to resist movement of the window sash 204 in the frame 210.

It will be appreciated that a toggle tilt type latch is provided which not only facilitates easy tilting operation but which also provides ready visual indication of whether a window sash is able to be tilted or not.

Whereas a particular embodiment of the invention has been described above for purposes of illustration, it would be evident to those skilled in the art that numerous variations of the details may be made without departing from the invention as defined in the appended claims.

I claim:

1. A window tilt latch, comprising:

base means for mounting said tilt latch on a window sash mounted in a window frame;

handle means pivotally mounted to said base means; and plunger operatively associated with said handle means, said tilt latch being adapted so that said window sash is not tiltable relative to said window frame in which said window sash is mounted when said plunger is in a first position and said window sash is tiltable relative to said window frame when said plunger is in a second position, whereby ready visual observation of the position of said handle means will indicate whether said plunger is in said first or second position and whereby said handle means can be sued as hand holes by a user to facilitate tilting said window sash with respect to said window frame.

2. The latch of claim 1, including ventilation latch means slidably mounted on said base means for selectively engaging said window frame.

3. The latch of claim 2, wherein said ventilation latch means has a finger which engages said window frame, whereby movement of said window sash ia partially obstructed.

4. The latch means of claim 3, wherein said ventilation latch has a flange positioned on the side opposite of said finger to facilitate manipulating said ventilation latch means.

5. The latch of claim 4, wherein said handle means has a continuous surface which covers said plunger and said base means when said plunger is in a first position so that dirt and dust will not accumulate in and around said base and plunger and so that tampering with said plunger is resisted.

6. The latch of claim 1, wherein said plunger includes a camming portion and a link portion, said link portion having one end attached to said handle means and the other end attached to said camming portion.

7. The latch of claim 6, wherein said camming portion is connected to said link portion by pivot means.

8. The latch of claim 7, wherein said camming portion has camming end means for engaging said window frame so as to resist tilting of said window sash.

9. The latch of claim 8, wherein said base means has a recess and said camming portion is slidably mounted in said recess.

10. The latch of claim 9, including a first pivot bar connecting said handle means to said base means.

11. The latch of claim 10, including locking means mounted on said latch for inhibiting movement of said handle means.

12. The latch of claim 11, wherein said locking means has a rotatable member having an adjustment end and a winged end, said winged end engaging a portion of said plunger to resist movement of said handle means away from said base means.

13. The latch of claim 12, wherein said pivot means includes a pair of mounting posts attached to the underside of said handle means and a second pivot bar traversing said mounting posts, said link portion adapted to be rotatable about said second pivot bar.

14. The latch of claim 13, wherein said base means has two inverted L-shaped flanges mounted on opposite sides thereof, said flanges defining an undercut track and said camming portion adapted for movement in said undercut track.

15. The latch of claim 14, wherein said camming end is triangular in shape.

16. The latch of claim 15, wherein said link portion is positioned in said recess when said plunger is in said first position.

17. The latch of claim 16, including mounting holes in said base means for mounting said tilt latch to said window sash.

18. The latch of claim 1, wherein said handle means has half-moon indentations defined therein to facilitate grasping thereof.

19. A window sash, comprising a plurality of rail members;

a first tilt latch mounted on one end of one of said rails and a second tilt latch mounted on the other end of said rails;

said first and second tilt latch each having a base, handle means pivotally mounted to said base and a plunger operatively associated with said handle means;

said plunger having a camming portion and a link portion having one end attached to said handle means and the other end attached to said camming portion; and said tilt latches being adapted so that said window sash is not tiltable relative to a window frame in which said window sash is mounted when said plunger is in a first position and said window sash is tiltable relative to said window frame when said plunger is in a second position, whereby ready visual observation of the position of said handle means will indicate whether said plunger is in said first or second position and whereby said handle means can be used as hand holds by a user to facilitate tilting said window sash relative to said window frame.

20. The window sash of claim 19, including a ventilation latch slidably mounted on said base.

21. The window sash of claim 19, including a ventilation latch slidably mounted on said base.

22. The window sash of claim 21, wherein said ventilation latch has a finger which is adapted to engage said window frame, whereby movement of said window sash is partially obstructed.

23. The window sash of claim 22, wherein said ventilation latch has a flange positioned on the side opposite of said finger to facilitate manipulating said ventilation latch.

24. The window sash of claim 23, wherein said handle means has a continuous surface which covers said plunger means and said base when said plunger is in a first position so that dirt and dust will not accumulate in and around said base and plunger means and so that tampering with said plunger means is resisted.

25. The window sash of claim 19, wherein said plunger includes a camming portion and a link portion, said link portion having one end attached to said handle means and the other end attached to said camming portion.

26. The window sash of claim 25, wherein said camming portion is connected to said link portion by pivot means.

27. The window sash of claim 26, wherein said camming portion has a camming end which is adapted to engage said window frame so as to resist tilting of said window sash.

28. The window sash of claim 27, wherein said base has a recess and said camming portion is slidably mounted in said recess.

29. The window sash of claim 28, including a first pivot bar connecting said handle means to said base.

30. The window sash of claim 29, including locking means mounted on said latch for inhibiting movement of said handle means.

31. The window sash of claim 30, wherein said locking means has a rotatable member having an adjustment end and a winged end, said winged end engaging a portion of said plunger to resist movement of said handle means away from said base.

32. The window sash of claim 31, wherein said pivot means includes a pair of mounting posts attached to the underside of said handle means and a second pivot bar traversing said mounting posts, said link portion adapted to be rotatable about said second pivot bar.

33. The window sash of claim 32, wherein said base has two inverted L-shaped flanges mounted on opposite sides thereof, said flanges defining an undercut track and said camming portion adapted for movement in said undercut track.

34. The window sash of claim 33, wherein said camming end is triangular in shape.

35. The window sash of claim 34, wherein said link portion is positioned in said recess when said plunger is in said position.

36. The window sash of claim 35, including mounting holes in said base for mounting said latch to said window sash.

37. A window sash, comprising:

a plurality of rail members;

a first tilt latch mounted on one end of one of said rails and a second tilt latch mounted on the other end of said rails;

said first and second tilt latch each having a base, handle means pivotally mounted on said base and a plunger operatively associated with said handle means, said tilt latches being adapted so said window sash is not tiltable relative to a window frame in which said window sash is mounted when said plunger is in a first position and said window sash is tiltable relative to said window frame when said plunger is in a second position, whereby ready visual observation of the position of said handle means will indicate whether said plunger is in said first or second position and whereby said handle means can be used as hand holds by a user to facilitate tilting said window sash relative to said window frame;

a ventilation latch slidably mounted on said base; and said handle means having a continuous surface which covers said plunger means and said base when said plunger is in a first position so that dirt and dust will not accumulate in and around said base and plunger means and so that tampering with said plunger means is resisted.

38. The window sash of claim 37, including locking means mounted on said latch for inhibiting movement of said handle means.

39. A window assembly comprising:

a window frame having a plurality of framing members;

a window sash having a plurality of rail members;

a first tilt latch mounted on one end of one of said rails and a second tilt latch mounted on the other end of one of said rails;

said first and second tilt latches each having a base, handle means pivotally mounted to said base and a plunger operatively associated with said handle means, said plunger has a camming portion and a link portion, said link portion having one end attached to said handle means and the other end attached to said camming portion; and said tilt latches being adapted so that said window sash is not tiltable relative to said window frame when said plunger is in a first position and said window sash is tiltable relative to said window frame when said plunger is in a second position, whereby ready visual observation of the position of said handle means will indicate whether said plunger is in said first or second position and whereby said handle means can be used as hand holds by a user to facilitate tilting said window sash relative to said window frame.

40. The latch of claim 39, wherein said camming portion is connected to said link portion by pivot means.

41. The window assembly of claim 40, including a first vertical framing member defining a channel;

a second vertical framing member defining a channel; and said camming portion having a camming end which is adapted to be received in said channel.

42. The window assembly of claim 41, including locking means mounted on said latch for inhibiting movement of said handle means so as to resist tilting of said window sash relative to said window frame.

43. The window assembly of claim 42, wherein said locking means has a rotatable member having an adjustment end and a winged end, said winged end engaging a portion of said plunger to resist movement of said handle means away from said base.

44. The window assembly of claim 42, including a ventilation latch slidably mounted on said base.

45. The window assembly of claim 44, including a top window sash and a bottom window sash mounted in said window frame, said tilt latches being mounted on said bottom sash.

46. The window assembly of claim 45, wherein said top window sash has a striker block mounted on a vertical rail member thereof and said ventilation latch has a finger which is adapted to engage said striker block so as to resist full movement of said bottom window sash in said window frame

47. The window assembly of claim 45, wherein said top window sash has a vertical rail member having apertures defined therein and said ventilation latch has a finger which is adapted to engage into said aperture so as to fix the position of said bottom window sash in said window frame.

48. The window assembly of claim 39, including a ventilation latch slidably mounted on said base.

49. The window assembly of claim 48, wherein said ventilation latch has a finger which is adapted to engage said window frame, whereby movement of said window sash is partially obstructed.

50. The window assembly of claim 49, wherein said ventilation latch has a flange positioned on the side opposite of said finger to facilitate manipulating said ventilation latch.

51. The window assembly of claim 50, wherein said handle means has a continuous surface which covers said plunger means and said base when said plunger is in a first position so that dirt and dust will not accumulate in and around said base and plunger means and so that tampering with said plunger means is resisted.

52. The window assembly of claim 51, wherein said camming portion has a camming end which is adapted to engage said window frame so as to resist tilting of said window sash.

53. The window assembly of claim 52, wherein said base has a recess and said camming portion is slidably mounted in said recess.

54. The window assembly of claim 53, including a first pivot bar connecting said handle means to said base.

* * * * *

UNITED STATES PATENT OFFICE

CERTIFICATE OF CORRECTION

PATENT NO. : 4,961,286

DATED : October 9, 1990

INVENTOR(S) : WILLIAM P. BEZUBIC

It is certified that error appears in the above-identified patent and that said Letters Patent are hereby corrected as shown below:

Claim 1, column 5, line 15, --a-- should be inserted before "plunger".

Claim 1, column 5, line 25, "sued" should be --used--; same line, "holes" should be --holds--.

Claim 3, column 5, line 34, "ia" should be --is--.

Claim 4, column 5, line 35, "means" should be deleted; line 36, --means-- should be inserted after "latch".

Claim 19, column 6, line 33, --one of-- should be inserted after "end of".

Claim 35, column 7, line 48, --first-- should be inserted after "said".

Claim 37, column 7, line 56, --one of-- should be inserted after "end of"; line 58, "on" should be --to--.

Signed and Sealed this

First Day of December, 1992

*Attest:*

*Attesting Officer*

DOUGLAS B. COMER

*Acting Commissioner of Patents and Trademarks*